United States Patent [19]

Braun et al.

[11] 4,420,892

[45] Dec. 20, 1983

[54] THIN FILM CONTACT DRYER

[75] Inventors: Burkhard Braun; Bernhard Vosteen; Reiner Skerhut, all of Cologne, Fed. Rep. of Germany; Adolf Sinn, Muri, Switzerland

[73] Assignee: Bayer Aktiengesellschaft, Leverkusen, Fed. Rep. of Germany

[21] Appl. No.: 343,791

[22] Filed: Jan. 29, 1982

Related U.S. Application Data

[63] Continuation of Ser. No. 126,764, Mar. 3, 1980, abandoned.

[30] Foreign Application Priority Data

Mar. 23, 1979 [DE] Fed. Rep. of Germany ..... 2911549

[51] Int. Cl.[3] ..... F26B 17/20

[52] U.S. Cl. ..... 34/183; 34/182; 366/149; 366/315

[58] Field of Search ..... 34/179, 180, 181, 182, 34/183, 135, 136, 137; 366/149, 315

[56] References Cited

U.S. PATENT DOCUMENTS

| | | | |
|---|---|---|---|
| 1,558,546 | 10/1925 | Hunter et al. | 34/181 |
| 2,138,240 | 11/1938 | Kobusch | 34/182 |
| 3,163,403 | 12/1964 | Engels | 366/315 |
| 3,617,225 | 11/1971 | Kuehne et al. | 366/149 |
| 3,808,701 | 5/1974 | Bachmann | 34/183 |

*Primary Examiner*—Larry I. Schwartz

*Attorney, Agent, or Firm*—Sprung, Horn, Kramer & Woods

[57] ABSTRACT

The thin film contact dryer consists of a rotor having flat rotor elements extending in a radial direction. In the central third of the rotor is arranged at least one combination of distributing elements and an annular weir which revolves with the rotor and leaves a narrow annular gap open to the internal dryer wall, the annular weir being arranged immediately downstream of the distributing elements as viewed in the direction of flow.

8 Claims, 3 Drawing Figures

(A-B)

THIN FILM CONTACT DRYER

This is a continuation of application Ser. No. 126,764, filed Mar. 3, 1980, now abandoned.

BACKGROUND OF THE INVENTION

The invention relates to a thin film contact dryer having a rotor. The moist material introduced is repeatedly spun on to the heated internal wall of the dryer, by the rotor, until it can finally be removed at the other end of the dryer in a dry, flowable form.

When moist materials are fed into a thin film contact dryer as a pumpable paste, relatively large agglomerates of product (lumps) form which are interspersed in the otherwise powdered dry material. These lumps are about the size of peas or hazel nuts. With a given granulation tendency, lump formation is also possible with flowable moist materials.

The lumps, which are still moist inside, make the dry material unusable as it does not meet the requirements concerning residual moisture, grindability and handling. Sieving and recirculating the lumpy fraction is very expensive. It has therefore been impossible hitherto to use the horizontal thin film contact dryer in cases where even small quantities of lumps are formed.

Accordingly, revolving distributing elements which are bent back have been developed which are intended to prevent the lumps from forming since the product is drawn into a conical gap between the distributing elements and the cylindrical heating surface (at rest) and are spread. It has been found, however, that although a significant reduction could be achieved in the lumpy fraction of the dry material, the reduction was never sufficient.

Another suggestion involves slanting the dryer to increase the product residence time to such an extent that the lumps are destroyed. However, this results in unpermissible mechanical stresses due to the increased quantity of product in the dryer.

SUMMARY OF THE INVENTION

The object of the invention is to develop a thin film contact dryer which always delivers a lump-free powdered dry material.

According to the invention there is provided a thin film contact dryer comprising a housing, and a rotor mounted in the housing, wherein in the central third of the rotor is arranged at least one combination of distributing elements and an annular weir which revolves with the rotor and leaves a narrow annular gap open to the internal wall of the housing, the annular weir being arranged immediately downstream of the distributing elements as viewed in the direction of flow.

In an advantageous form of this arrangement, the width d of the annular gap is larger than the distance s between the distributing elements and the dryer wall.

An embodiment in which several units of distributing elements and annular weir are connected in series has proved advantageous for substances which have a particularly marked tendency to agglomerate and form lumps.

The annular gap does not prevent the already powdered flowable product fractions, which are distributed in a thin film over the periphery of the dryer by the high centrifugal forces, from being conveyed. On the other hand, the lumps are retained by the annular weir until they are grasped by the distributing elements and are comminuted to powder until they can also pass through the annular gap. The maximum particle size of the dry material thus corresponds to the width of the annular gap. A particular advantage of this arrangement lies in the fact that no complicated changes are needed on the thin film dryer. The annular weir and associated distributing elements can also easily be fitted subsequently into already existing installations. Thus, the numerous advantages of the thin film contact dryer can also be used for those products which hitherto had to be dried in a different manner due to their tendency to agglomerate and form lumps.

An embodiment of the invention is described in more detail below with reference to the accompanying drawings.

Figure 1:
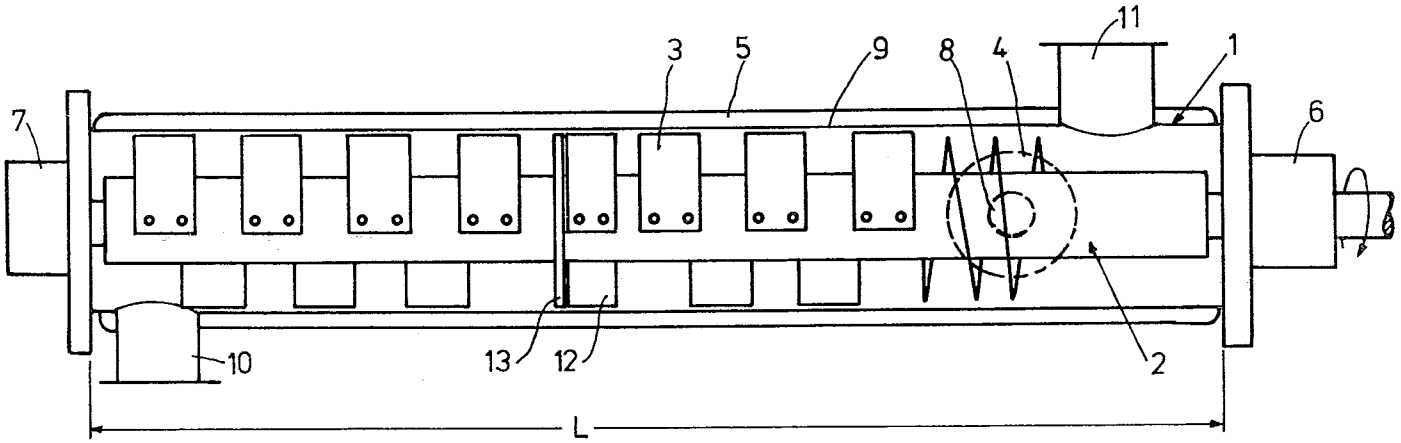
FIG. 1 shows the basic structure of a thin film dryer according to the invention.

The thin film contact dryer shown in FIG. 1 stands generally horizontally. The basic components of the dryer are a cylindrical housing 1, a rotor 2 with rotor elements 3 and an inlet screw 4 at the right-hand end. The rotor elements are known conveying, spring and roller elements. The dryer housing 1 is provided with a heating casing 5. The dryer has sealing flanges 6 and 7 at its ends. The pasty material to be dried is introduced in the region of the inlet screw 4 through a nozzle 8. It is then grasped by the rotor elements 3 and spun on to the internal wall 9 of the drying chamber. Owing to the centrifugal forces occurring, the product is conveyed on to only a narrow annular zone on the internal wall 9 of the dryer. The dried product is removed through a product outlet 10 at the left-hand end of the dryer. The vapours produced are drawn off through a nozzle 11.

Figure 2:
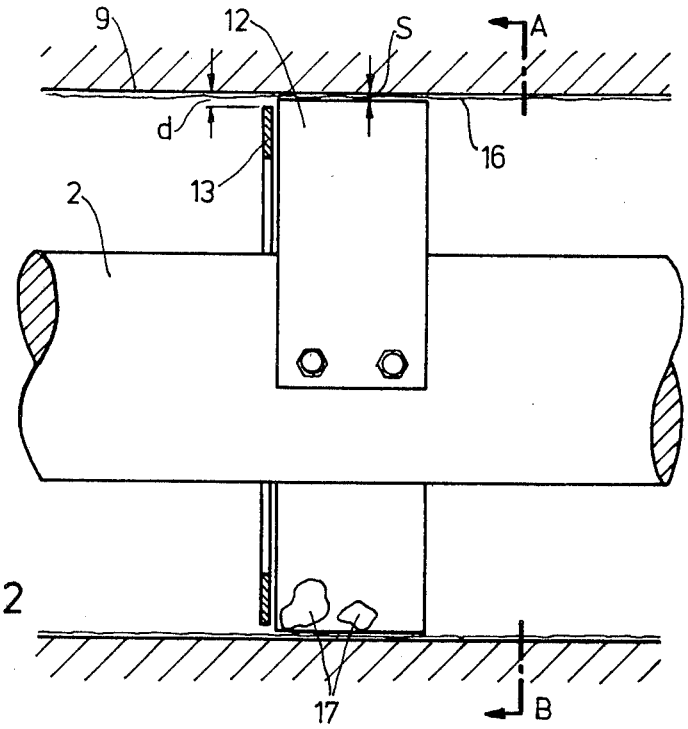
FIG. 2 shows a detail of the thin film dryer with distributing elements and annular weir.
Figure 3:
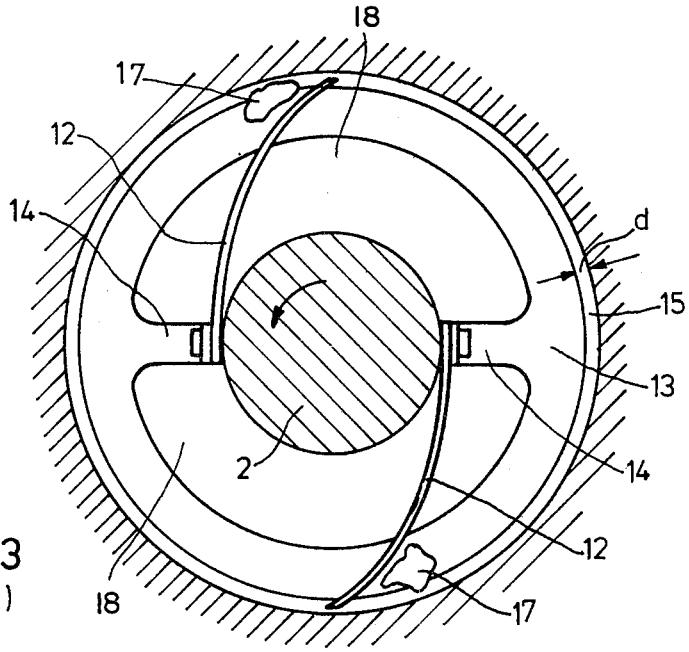
FIG. 3 shows a section along line A/B in FIG. 2.

The rotor is provided with an annular weir 13 and associated distributing elements 12 in the central third of the dryer (cf. magnified detail in FIGS. 2 and 3). The annular weir 13 is directly downstream of the associated distributing elements 12, i.e. to the left thereof. FIG. 3 shows the shape of the annular weir 13 and the associated distributing elements 12. The distributing elements 12 consist of metal sheets which are bent back and are fixed centrally on the rotor 2 and end immediately in front of the internal wall 9 of the dryer. The distance s between the outer edge of the distributing elements 12 and the internal wall 9 is of the order, for example, of 1 mm. The annular weir 13 immediately downstream consists of an annular disc which is fixed in the centre by cross members 14 on the rotor 2. The radius of the annular disc is such that a narrow annular gap 15 remains between its outer rim and the internal wall 9 of the dryer. The width d of this gap must be greater than the distance s between the distributing elements 12 and the dryer wall 9. In practice it is between 2 and 5 mm. The annular weir 13 should be joined flush with the distributing elements if possible. However, the distance between the annular weir and distributing elements should never exceed the width d of the annular gap 15.

The moist material 16, which has agglomerated in part into lumps 17, is carried along the internal wall 9 of the dryer by the centrifugal forces and, in the process, is dried by the heat supplied by the heating casing 5. As soon as the lumps 17 enter the inlet region of the distributing elements 12, they are comminuted by pressure and friction. The annular weir 13 prevents the lumps 17 from rolling between the associated distributing elements 12 and from avoiding being acted on by them. The annular weir 13 operates in such a way that the lumps 17 accumulate in the region of the associated distributing elements 12. The vapours can flow out unobstructed through large semi-circular openings 15 in the annular weir 13. A retarding disc with openings (for the passage of the vapours) would therefore serve the same purpose as the annular weir 13 described herein.

With products having a particularly marked tendency to agglomerate the likelihood of lumps forming can be further reduced if several units each consisting of an annular weir 13 and distributing elements 12 are connected in series in the dryer.

The position of a unit of this type in the dryer is not very critical. However, it is essential to arrange the annular weir connected to the associated distributing elements at a distance from the product inlet 8 which corresponds to at least one third and at most two thirds of the rotor length L. If the annular weir 13 is arranged too close to the inlet 8, the gap 15 can be blocked by product which has not yet been converted into the powder phase. If it is brought too close to the product outlet 10 is is not possible to ensure that the comminuted lump constituents are sufficiently dry.

In experiments using this apparatus it was found that only particles having a particle size $<d$ were present in the dry material at the product outlet 10, even in the case of markedly agglomerating substances (marked tendency to form lumps). The field of application of thin film contact dryers can thus be enlarged to include lump-forming products. An important economic aspect of the invention lies in the fact, moreover, that the annular weir 13 and associated distributing elements 12 can be fitted into existing installations at any subsequent time.

We claim:

1. A thin film contact dryer comprising a stationary housing having a closed cylindrical internal wall, an inlet at one end and an outlet at the other end, means for heating the housing wall, means for effecting an axial flow from the inlet to the outlet and a rotor mounted for rotation in the housing and extending longitudinally throughout the length thereof, wherein along the rotor between the inlet and the outlet is arranged a unit comprising at least one combination of distributing elements and an annular weir which revolves with the rotor and leaves a constant 360° narrow annular gap open with respect to the internal wall of the housing, the distributing elements being bent back with respect to the direction of rotation to form wedge shaped corners with the internal surface of the housing and the annular weir being disposed immediately downstream of the distributing elements in the direction of axial flow and apertured in an annular region adjacent to said rotor to permit vapor flow therethrough.

2. A thin film contact dryer according to claim 1, wherein the width of the said annular gap is greater than the distance between the associated distributing elements and the internal wall of the housing.

3. A thin film contact dryer according to claim 1 or 2, wherein a plurality of said units are arranged in series.

4. The dryer according to claim 1, wherein the distributing elements are centrally mounted on the rotor.

5. The dryer according to claim 2, wherein the width of the gap is between 2 and 5 mm and the distance between the distributing elements and the internal wall is on the order of 1 mm.

6. The dryer according to claim 2, wherein the distance between the weir and the distributing elements is not greater than the width of the annular gap.

7. A dryer according to claim 1, wherein the unit is arranged along the central third of the rotor.

8. A device for preventing lumping in rotary dryers and the like having a closed stationary cylindrical housing with a longitudinally extending rotor rotationally mounted therein with means for effecting an axial flow in one direction in the housing, the device comprising at least one distributing element for mounting on the rotor for rotation therewith, the distributing element being bent back with respect to the direction of rotation to form a wedge shaped corner with the internal surface of the housing and configured to terminate just before the internal surface of the housing and an annular weir mountable on the rotor for rotation therewith flush against the distributing element and downstream thereof in the one direction of axial flow and having a constant diameter slightly less than that of the path of the distributing element and extending around 360° and apertures in an annular region adjacent to said rotor to permit vapor flow therethrough.

* * * * *

UNITED STATES PATENT AND TRADEMARK OFFICE

CERTIFICATE OF CORRECTION

PATENT NO. : 4,420,892

DATED : December 20, 1983

INVENTOR(S) : Burkhard Braun et al.

It is certified that error appears in the above-identified patent and that said Letters Patent is hereby corrected as shown below:

On the cover page, after "Assignee". delete " Bayer Aktiengesellschaft, Leverkusen, Fed. Rep. of Germany" and insert therefor -- Luwa Aktiengesellschaft, Zurich, Switzerland --.

Signed and Sealed this

*Fourth* Day of *December 1984*

[SEAL]

*Attest:*

GERALD J. MOSSINGHOFF

*Attesting Officer*

*Commissioner of Patents and Trademarks*